US007775359B2

(12) United States Patent
Maeda

(10) Patent No.: US 7,775,359 B2
(45) **Date of Patent: *Aug. 17, 2010**

(54) PACKAGING FOR PAPER ROLL

(75) Inventor: Mitsuru Maeda, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 42 days.

This patent is subject to a terminal disclaimer.

(21) Appl. No.: 12/219,750

(22) Filed: Jul. 28, 2008

(65) Prior Publication Data

US 2009/0038971 A1 Feb. 12, 2009

(30) Foreign Application Priority Data

Jul. 31, 2007 (JP) ..... 2007-198391

(51) Int. Cl.
*B65D 85/02* (2006.01)

(52) U.S. Cl. ..... 206/391; 206/396; 206/397; 206/585

(58) Field of Classification Search ..... 206/389, 206/395, 397, 576, 320, 446, 784, 391, 585; 400/207

See application file for complete search history.

(56) References Cited

U.S. PATENT DOCUMENTS 1,284,082 A * 11/1918 Flanigan ..... 206/408
2,101,282 A * 12/1937 Piper ..... 206/395
4,714,191 A * 12/1987 Richardson ..... 206/395
5,205,412 A 4/1993 Krieg
5,246,111 A * 9/1993 Shibazaki et al. ..... 206/397
5,704,479 A * 1/1998 Barnett et al. ..... 206/395
5,813,523 A 9/1998 Gnadt et al.
2009/0169283 A1 * 7/2009 Maeda et al. ..... 400/207

FOREIGN PATENT DOCUMENTS

CH 460 628 7/1968
JP 07-069341 3/1995

* cited by examiner

*Primary Examiner*—J. Gregory Pickett
(74) *Attorney, Agent, or Firm*—Fitch Even Tabin & Flannery; Kendrew H. Colton

(57) ABSTRACT

The packaging of the present invention is provided with a printing paper roll to which printing paper is wound; an ink ribbon unit having a sending roll, a winding roll arranged in parallel to the sending roll and an ink ribbon wound around the sending roll; a container for storing the printing paper roll and the ink ribbon unit; a partition member disposed in the container for partitioning the printing paper roll from the ink ribbon unit, wherein the partitioning member comprises a pair of plate-like holding members for holding the printing paper roll at its ends in the axial direction and a plate-like connecting member for connecting the holding members; and the connecting member obliquely extending relative to the axial direction, and partitioning the container in the radial direction of the printing paper roll into first and second storage regions in which the printing paper roll and the ink ribbon unit are accommodated respectively.

6 Claims, 2 Drawing Sheets

PACKAGING FOR PAPER ROLL

CROSS-REFERENCE TO RELATED APPLICATION

This application claims priority claims the benefit of foreign priority under 35 U.S.C. §119 based on 2007-198391, filed in Japan on Jul. 31, 2007, the entire disclosure of which application is hereby incorporated herein by reference.

BACKGROUND ART

The present invention relates to packaging in which a printing paper and an ink ribbon unit are accommodated.

Several types of packaging for accommodating rolled products have been proposed, for example, in Japanese Unexamined Patent Publication No. 1995-69341. Various forms are employable for packing rolled products. In recent years, there have been numerous attempts to store accessories together with rolled products in the same package. For example, in terms of a printing paper, which is a rolled product, it is more convenient for users if the printing paper is stored with an ink ribbon unit, which conducts printing on the printing paper roll, in the same package.

The above-mentioned ink ribbon unit includes a sending roll to which an ink ribbon is rolled and a winding roll, which is arranged parallel to the sending roll. In the ink ribbon unit, the sending roll and the winding roll are arranged in one set. In the ink ribbon unit, the sending roll has a larger diameter and the winding roll has a smaller diameter, when not used. In the ink ribbon unit, two rolls having different diameters are disposed in parallel, i.e., having irregular shaped components, and therefore it is difficult to fix them in a container. When a cubic or rectangular item having parallel opposing surfaces is stored, it can be fixed to the container with a relatively simple fixture or partition. In contrast, when the above-mentioned item having an irregular shape is stored, a fixer with a complicated shape or additional component becomes necessary to fill the gaps formed by the irregular shape. This increases the number of components necessary.

The present invention aims to solve the above problem, and provides packaging that can reliably store an irregular shaped ink ribbon unit with a fewer number of components.

SUMMARY OF THE INVENTION

The packaging of the present invention is provided to solve the above problem. The packaging of the present invention includes a printing paper roll around which printing paper is wound, an ink ribbon unit having a sending roll, a winding roll disposed in parallel to the sending roll and an ink ribbon wound around the sending roll, a container for storing the printing paper roll and the ink ribbon unit, and a partition member disposed in the container for partitioning the printing paper roll and the ink ribbon unit. The partition member has a pair of plate-like holding members, which sandwich the printing paper roll at its ends in the axial direction; and a plate-like connecting member for connecting the pair of holding members. The connecting member forms a partition inside the container in the radial direction of the printing paper roll so as to have first and second storage regions. Here, the printing paper roll is disposed in the first storage region and the ink ribbon unit is disposed in the second storage region, and the connecting member obliquely extends relative to the axial direction.

In this structure, the connecting member in the partition member partitions the container in such a manner that the printing paper roll and the ink ribbon unit are aligned in the radial direction of the printing paper roll. The connecting member obliquely extends relative to the axial direction of the printing paper roll. The second storage region, in which the ink ribbon unit is stored, therefore becomes smaller from one end of the shaft core to the other end. The ink ribbon unit can be stored so that the sending roll, which has a larger diameter, is disposed in one end of the printing paper roll and the winding roll, which has a smaller diameter, is disposed in the other end. Accordingly, a space suitable for accommodating an ink ribbon unit having rolls of different diameters can be provided, so that the ink ribbon unit can be reliably fixed.

As described above, the partition member for separating the printing paper roll from the ink ribbon unit is simply formed from a pair of holding members and a connecting member. This makes special components for filling gaps unnecessary and decreases the number of components required. Accordingly, this results in a cost reduction.

The printing paper roll is arranged between the pair of holding members. In this arrangement, it is preferable that a fixing member be provided to each of the holding members for fastening the printing paper roll. When the printing paper roll has a shaft core space in the cylindrical shaft core part, the fixing member, for example, may be structured so as to hold the printing paper roll in the following manner. A shaft fixing member is provided to each of the holding members in such a manner that it projects toward the printing paper roll and is fitted in the shaft core space. This structure achieves reduction of space because fixing is conducted by using a member that fits inside of the printing paper roll.

The partition member may have various modes; for example, one end of the connecting member may be connected to the middle part of one holding member, and the other end of the connecting member may be connected to the end of the other holding member or in the vicinity thereof. This arrangement makes it possible to incline the connecting member relative to the axial direction. Alternatively, the following arrangement may be employed. Specifically, they are integrally formed in such a manner that one of the holding members, the connecting member, and the other holding member are aligned in this order in the developed view of the partition member, and the connecting member has a belt-like shape having a smaller width than the holding member. Along the direction in which the connecting member extends, the connecting member extends to the middle part thereof by a notch formed in the holding member, and the connecting member can be folded at this middle part. Such arrangement makes it possible to integrally form the partition member from a single plate, etc., and reduces its cost and simplifies its production. The term "middle part" means an arbitrary point somewhere between the two ends of the holding member, and it does not have to be exactly the mid point of the holding member.

The printing paper roll and the ink ribbon unit used in the present invention achieve not only the formation of images but also the printing of characters. As long as the printing paper is wound into a roll, there is no limitation to the material and size thereof. Also, there is no limitation to the ink ribbon.

The packaging of the present invention makes it possible to reliably fix an irregular shaped ink ribbon unit with a small number of components.

DETAILED DESCRIPTION OF THE INVENTION

Figure 1:
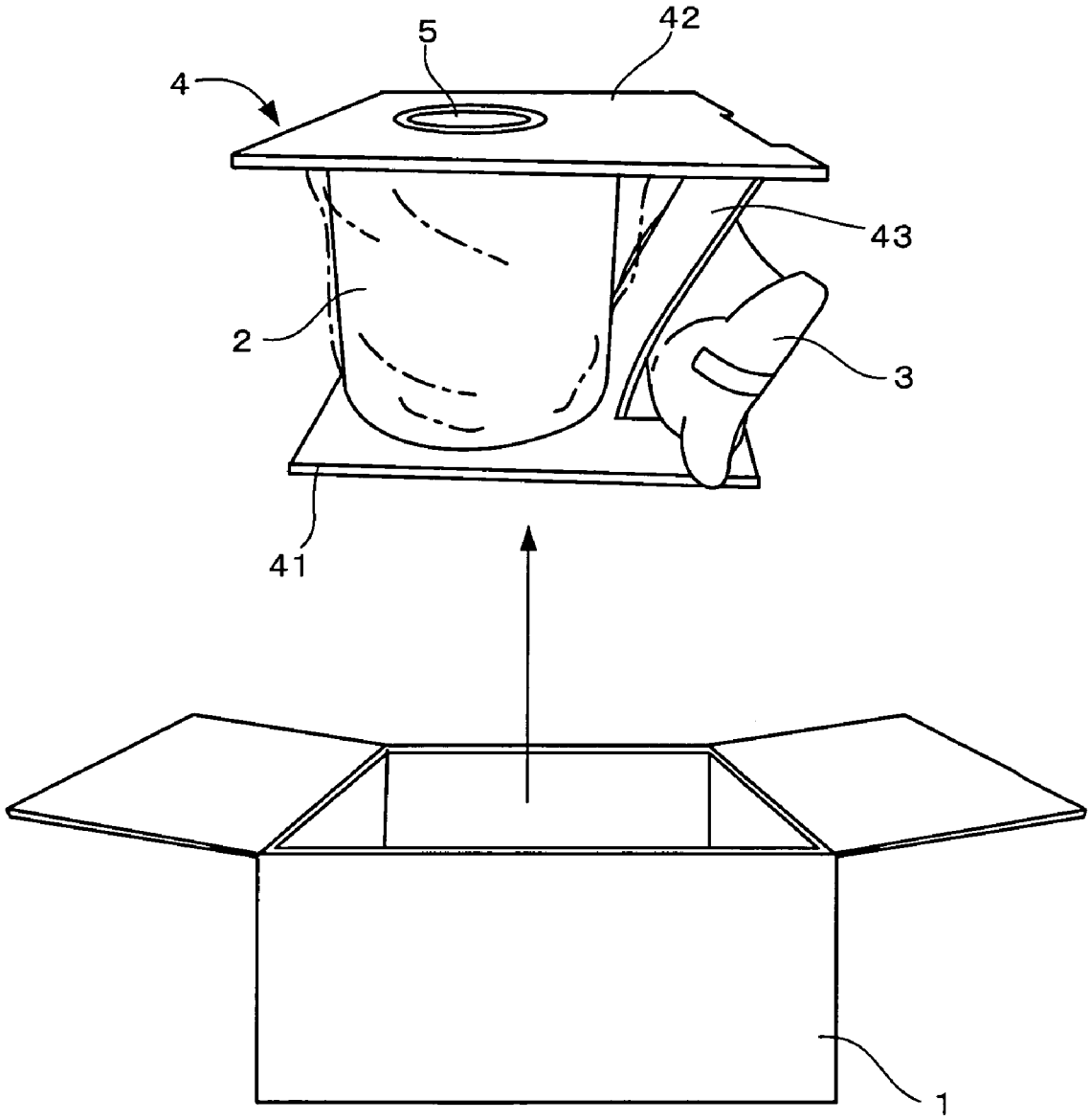
FIG. 1 is a perspective exploded view showing packaging according to one embodiment of the present invention.
Figure 2:
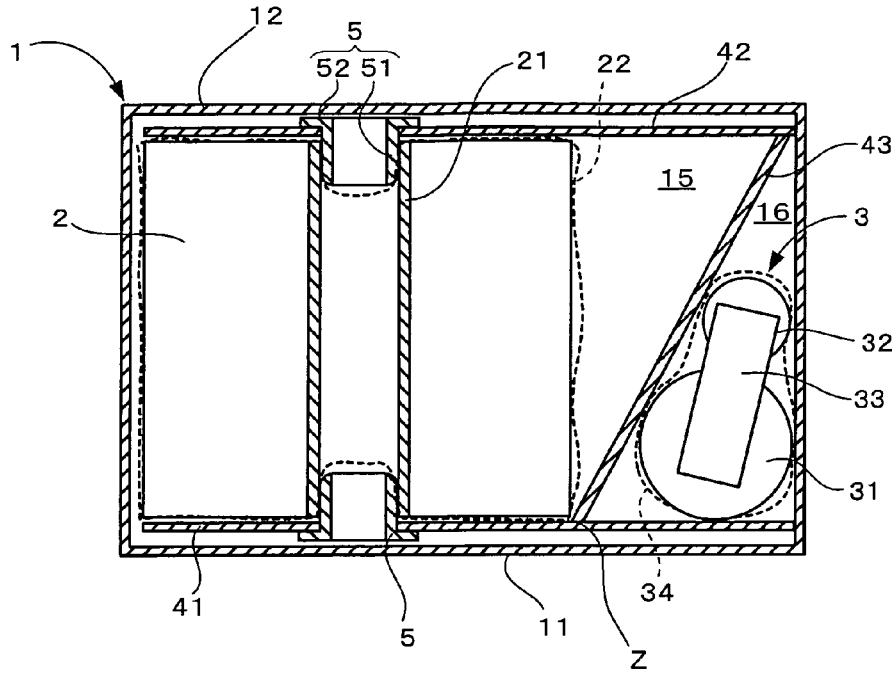
FIG. 2 is a cross-sectional view of the packaging shown in FIG. 1.

Packaging according to one embodiment of the present invention is explained below with reference to the drawings. FIG. 1 shows a perspective exploded view of the packaging from which the contained item is removed. FIG. 2 is a cross-sectional view of the packaging of FIG. 1.

As shown in FIG. 1, the packaging includes a rectangular paper container 1, which accommodates a printing paper roll 2, and an ink ribbon unit 3 that achieves printing on the printing paper roll 2. The container 1 also accommodates a partition member 4 that partitions the printing paper roll 2 and the ink ribbon unit 3. The partition member 4 allows the printing paper roll 2 to be disposed in the left part of the container 1 and the ink ribbon unit 3 to be disposed in the right part of the container 1 as shown in FIG. 2.

The printing paper roll 2 is a known one. Specifically, the printing paper roll 2 has a cylindrical form as a whole, achieved by winding printing paper around a cylindrical shaft core 21. The printing paper roll 2 is stored in the container 1, after being placed inside a soft resin bag 22 in order to protect the printing paper. The printing paper roll 2 is then placed in the container 1 in such a manner that the shaft core 21 extends in the vertical direction. As shown in FIG. 2, the length of the shaft core 21 is substantially the same as the height of the container 1.

The ink ribbon unit is also a known one. As shown in FIG. 2, the ink ribbon unit has a sending roll 31 onto which an ink ribbon is wound, and a winding roll 32 that is arranged in parallel to the sending roll 31. These rolls 31 and 32 are connected by a connecting member 33, which connects the axial ends of the sending roll with those of the winding roll. Due to such a construction, the ink ribbon unit 3 has an irregular shape with the two rolls 31 and 32 having different diameters being disposed side by side. Similar to the printing paper roll 2, the ink ribbon unit is placed in a soft resin bag 33 before being stored in the container 1.

Figure 3:
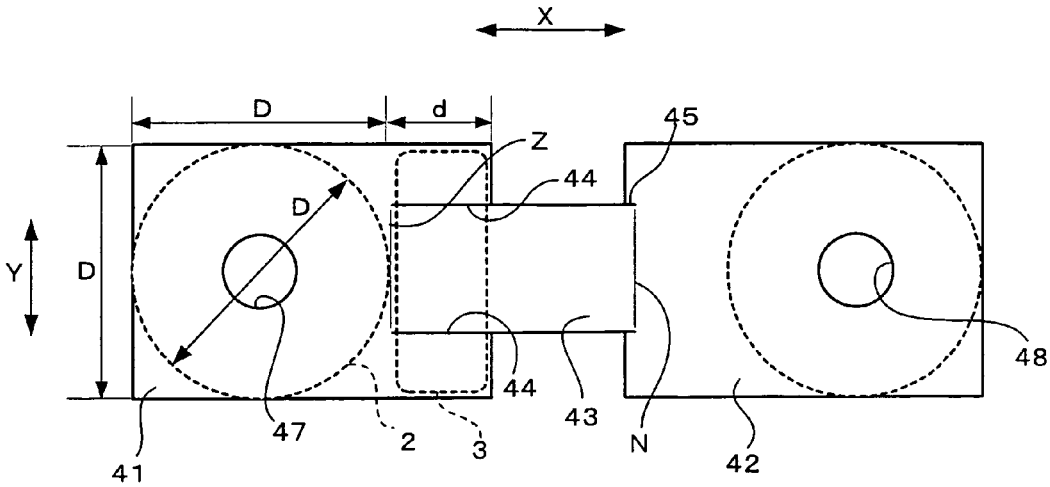
FIG. 3 is a developed view of a partition member.

An explanation of the partition member is given below with reference to FIG. 3. FIG. 3 is a developed view of the partition member. As shown in FIG. 3, the partition member 4 is formed from thick paper and has a plate-like shape. The partition member has a pair of rectangular holding members 41 and 42, and a belt-like connecting member 43 for connecting the holding members. Each of the holding members 41 and 42 has a rectangular shape with almost the same size as the top and bottom surfaces of the container 1. As shown in FIG. 2, the holding members 41 and 42 are arranged so as to be in contact with each of the ends in the axial direction of the printing paper roll 2 and sandwich the printing paper roll 2 vertically. In this specification, the holding member disposed in the upper part of the container 1 is referred to as the first holding member 41 and that disposed in the lower part of the container 1 is referred to as the second holding member 42. The first holding member 41 is in contact with the bottom surface 11 of the container 1 and the second holding member 42 is in contact with the top surface 42 of the container 1.

As shown in FIGS. 2 and 3, on the top of the first holding member 41, the printing paper roll 2 is arranged on the left side, and the ink ribbon unit 3 is arranged on the right side of the boundary Z. More specifically, as shown in FIG. 3, the length of the first holding member 41 in the width direction Y (in the vertical direction in FIG. 3) corresponds to the diameter D of the printing paper roll 2. The length of the first holding member 41 in the length direction X (in the horizontal direction in FIG. 3) is slightly longer than the total length of the diameter D of the printing paper roll 2 and the diameter d of the sending roll 31. The second holding member 42 has the same size as the first holding member 41. As shown in FIG. 3, in a developed view, the printing paper roll 2 is located in the left part of the drawing. In the holding members 41 and 42, through holes 47 and 48, which fix the shaft core 21, are formed in the locations where the printing paper roll 2 is disposed. The printing paper roll 2 is fixed to the holding members 41 and 42 with a shaft fixing member as described later.

As shown in FIG. 3, in the first holding member 41, a pair of notches 44 extending from the right end of the first holding member 41 in the length direction X is formed. The notches extend so as to extend the connecting member, so that the connecting member 43 extends until the middle of the first holding member. The end of the connecting member serves as the above-mentioned boundary Z. With this arrangement, the notches 44 allow the connecting member 43 to bend not at a fold in the right end of the first holding member 41 but at a fold in the middle in the length direction X, i.e., at the boundary Z. Likewise, in the second holding member 42, short notches 45 are formed from the left end thereof. The connecting member 43 can be bent at a fold in the location N, which is slightly inward from the left end of the second holding member 42.

In this arrangement, the partition member 4 is bent at the folds Z and N so as to form a U-like shape and stored in the container 1 as shown in FIG. 2. In the container 1, having the connecting member 43 in between, the printing paper roll 2 is disposed in the first storage region 15, which is located in the left part of the container 1, and the ink ribbon unit 3 is disposed in the second storage region 16, which is located in the right part of the container 1. In this arrangement, because the fold Z in the lower part of the connecting member 43 is formed at the middle of the first holding member 41, the width of the second storage region 16 becomes narrower from the bottom to the top as seen from the front view. Therefore, the ink ribbon unit 3 is stored with the axes of the rolls 31 and 32 perpendicularly crossing over the shaft core 21 of the printing paper roll 2. The sending roll 31, which has a larger diameter, is disposed in the lower part and the winding roll 32, which has a smaller diameter, is disposed in the upper part of the container 1.

The printing paper roll 2 stored in the first storage region 15 is fixed using a shaft fixing member described below. The shaft fixing member 5 includes a cylindrical main body 51 and a flange 52 projecting from one end in an axial direction toward the radial direction respectively fitted in the through holes 47 and 48 formed in the holding members 41 and 42. As shown in FIG. 2, each of the shaft fixing members 5 is inserted into the through holes 47 and 48 from the surface opposite to the roll 2 of the holding members 41 and 42, in such a manner that they project toward the roll. In this case, the flange 52 is fitted to the periphery around the through holes 47 and 48. This arrangement allows the shaft fixing member 5 to be fastened without coming off from the holding members 41 and 42.

As described above, in the present embodiment, because the fold Z in the lower part of the connecting member 43 is disposed in the middle of the first holding member 41, the second storage region 16 in which the ink ribbon unit 3 is stored becomes narrower from the bottom to the top thereof. In other words, this structure provides a storage space that is suitable for the ink ribbon unit 3, which has rolls with different diameters, and therefore the ink ribbon unit 3 can be reliably fixed. Furthermore, the partition member 4 that partitions the printing paper roll 2 and the ink ribbon unit 3 is formed simply from a pair of holding members 41 and 42 and the connecting member 43 as described above. This makes any additional parts for filling gaps unnecessary, i.e., it reduces the number of parts required, and accordingly reduces the production cost.

One embodiment of the present invention is explained above; however, the present invention is not limited to this and various modifications may be added as far as they do not depart from the intention of the present invention. For example, the partition member may have various constructions. There is no limitation to the structure of the partition member as long as its connecting member obliquely extends as seen from a front view and the second storage region becomes narrower from one side to the other when the partition member is stored in the container. In the present embodiment, the partition member 4 is integrally formed, but it can be separately formed and connected. In this case, for example, the connecting member may be formed as a separate part and pivotably connected at the middle part of the holding member. It is also possible to form the partition member from a simple U-shaped plate as long as the connecting member that is located in the middle part of the connecting member obliquely extends.

The means for fixing the printing paper roll to the holding member is not limited to the above-described shaft fixing member, and various other means may be employed as long as they can fix the printing paper roll to the holding member. The container may accommodate not only one printing paper roll and one ink ribbon unit but also other components, such as additional printing paper rolls, etc. Therefore, various other structures may be employed as long as the connecting member, which partitions the printing paper roll and the ink ribbon unit, obliquely extends so that the second storage region for storing the ink ribbon unit can take the above-mentioned construction.

The invention claimed is:

1. Packaging comprising:

a printing paper roll to which printing paper is wound;

an ink ribbon unit having a sending roll, a winding roll arranged in parallel to the sending roll and an ink ribbon would around the sending roll;

a container for storing the printing paper roll and the ink ribbon unit;

a partition member disposed in the container for partitioning the printing paper roll from the ink ribbon unit, wherein the partitioning member comprises a pair of plate-shaped holding members for holding the printing paper roll at its ends in the axial direction and a plate-shaped connecting member for connecting the holding members; and the connecting member obliquely extending relative to the axial direction, and partitioning the container in the radial direction of the printing paper roll into first and second storage regions in which the printing paper roll and the ink ribbon unit are accommodated respectively.

2. The packaging according to claim 1, wherein the printing paper roll has a cylindrical shaft core space in the shaft core part, and a shaft fixing member is provided to each of the holding members in such a manner that the shaft fixing member projects toward the printing paper roll and fits into the shaft core.

3. The packaging according to claim 1, wherein the partitioning member is formed in such a manner that one holding member, a connecting member, and the other holding member are integrally formed and aligned in this order when the partition member is developed;

wherein the connecting member is belt-shaped and has a width smaller than that of the holding members;

the connecting member extends to the middle part of one holding member through a notch formed in the direction the connecting member extends; and the connecting member can be folded at the middle part.

4. The packaging according to claim 1, wherein each of the holding members has substantially the same size as the surface of the container which the edges of the shaft core of the printing paper roll face.

5. The packaging according to claim 2, wherein each of the holding members has substantially the same size as the surface of the container which the edges of the shaft core of the printing paper roll face.

6. The packaging according to claim 3, wherein each of the holding members has substantially the same size as the surface of the container which the edges of the shaft core of the printing paper roll face.

* * * * *

UNITED STATES PATENT AND TRADEMARK OFFICE

CERTIFICATE OF CORRECTION

PATENT NO. : 7,775,359 B2
APPLICATION NO. : 12/219750
DATED : August 17, 2010
INVENTOR(S) : Mitsura Maeda It is certified that error appears in the above-identified patent and that said Letters Patent is hereby corrected as shown below:

Claim 1, line 5, change "~~would~~" to "wound".

Signed and Sealed this

Twenty-third Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,775,359 B2
APPLICATION NO. : 12/219750
DATED : August 17, 2010
INVENTOR(S) : Mitsura Maeda It is certified that error appears in the above-identified patent and that said Letters Patent is hereby corrected as shown below:

Column 5, line 44 (Claim 1, line 5) change "~~would~~" to "wound".

This certificate supersedes the Certificate of Correction issued November 23, 2010.

Signed and Sealed this

Fourteenth Day of December, 2010

David J. Kappos

David J. Kappos
*Director of the United States Patent and Trademark Office*